United States Patent [19]

Eidem

[11] Patent Number: 4,752,382

[45] Date of Patent: Jun. 21, 1988

[54] REDUCING THE METALS CONTENT OF PETROLEUM FEEDSTOCKS

[75] Inventor: Penny K. Eidem, Novato, Calif.

[73] Assignee: Chevron Research Company, San Francisco, Calif.

[21] Appl. No.: 672,450

[22] Filed: Nov. 16, 1984

[51] Int. Cl.[4] ..... C10C 3/00; C10C 21/00

[52] U.S. Cl. ..... 208/309; 208/252; 208/45; 208/251 R

[58] Field of Search ..... 208/252, 309

[56] References Cited

U.S. PATENT DOCUMENTS

| | | | |
|---|---|---|---|
| 1,163,025 | 12/1915 | Mann et al. | 208/311 |
| 1,962,181 | 6/1934 | Egloff | 208/298 |
| 2,145,852 | 2/1939 | Bahlke et al. | 208/309 |
| 2,546,916 | 3/1951 | Badertscher et al. | 208/309 |
| 2,682,496 | 6/1954 | Richardson et al. | 208/90 |
| 2,847,362 | 8/1958 | Kemp | 208/309 |
| 3,095,368 | 6/1963 | Bieber et al. | 208/252 |
| 3,245,902 | 4/1966 | Adams et al. | 208/252 |
| 3,434,963 | 3/1969 | Kemp et al. | 208/252 |
| 4,411,774 | 10/1983 | Johnson | 208/252 |
| 4,419,225 | 12/1983 | Kukes et al. | 208/251 R |
| 4,421,638 | 12/1983 | Nowack et al. | 208/251 R |
| 4,502,940 | 3/1985 | Tabler | 208/251 R |
| 4,522,702 | 6/1985 | Kukes et al. | 208/252 |

FOREIGN PATENT DOCUMENTS

| | | | |
|---|---|---|---|
| 1212662 | 5/1962 | Fed. Rep. of Germany | 208/252 |
| 313433 | 12/1929 | United Kingdom | 208/309 |

*Primary Examiner*—Helen M. S. Sneed
*Assistant Examiner*—Helane Myers
*Attorney, Agent, or Firm*—S. R. La Paglia; T. G. DeJonghe

[57] ABSTRACT

The metals content of petroleum feedstocks, particularly those feedstocks comprising maltenes and asphaltenes, is reduced prior to further processing by contacting the feedstock with phosphoric acid.

12 Claims, 1 Drawing Sheet

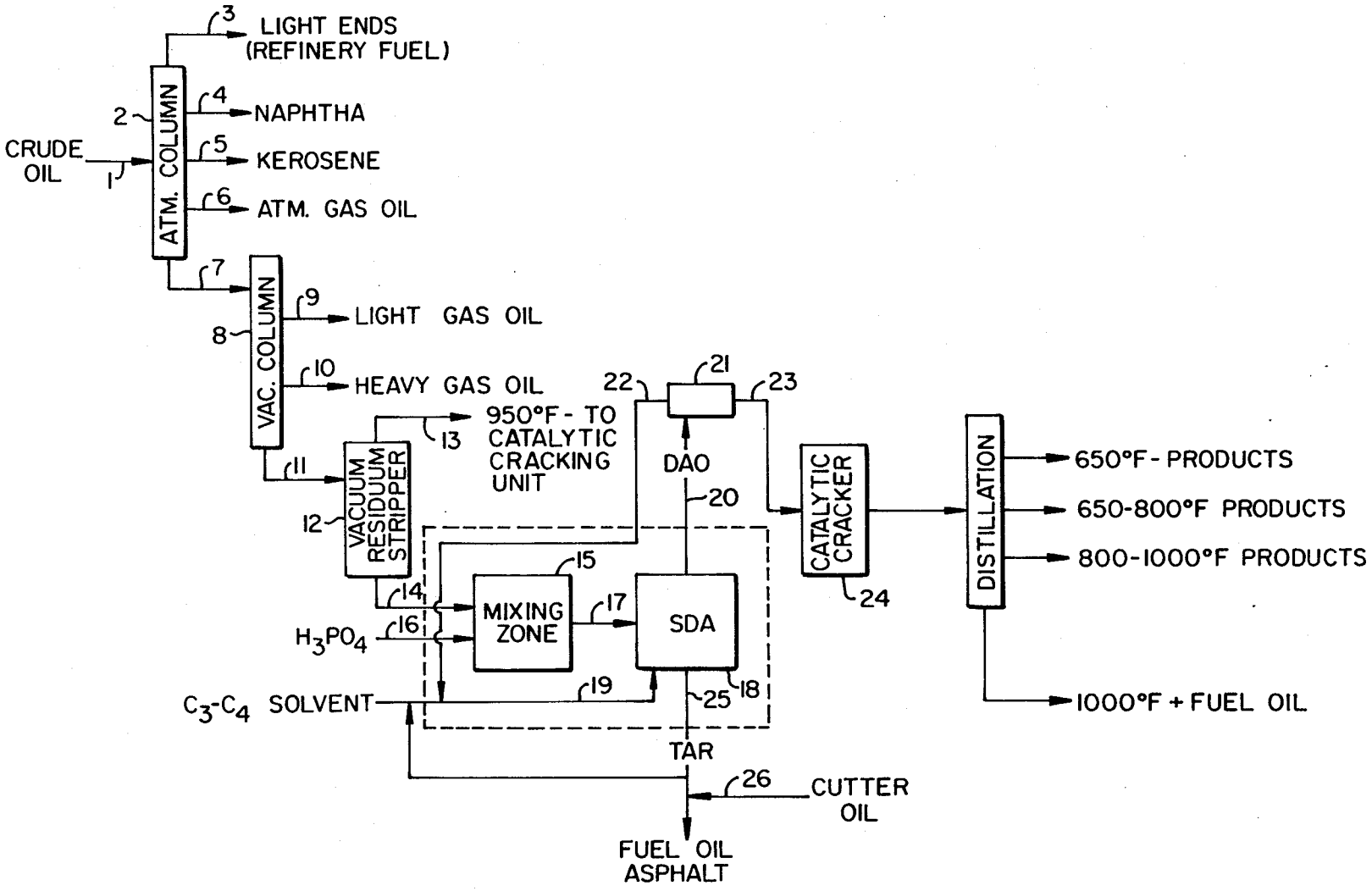
CRUDE OIL
1
2
ATM. COLUMN
3
LIGHT ENDS (REFINERY FUEL)
4
NAPHTHA
5
KEROSENE
6
ATM. GAS OIL
7
8
VAC. COLUMN
9
LIGHT GAS OIL
10
HEAVY GAS OIL
11
12
VACUUM RESIDUUM STRIPPER
13
950°F - TO CATALYTIC CRACKING UNIT
14
15
MIXING ZONE
16
$H_3PO_4$
17
SDA
18
19
$C_3$-$C_4$ SOLVENT
20
DAO
21
22
23
24
CATALYTIC CRACKER
DISTILLATION
650°F - PRODUCTS
650-800°F PRODUCTS
800-1000°F PRODUCTS
1000°F + FUEL OIL
25
TAR
26
CUTTER OIL
FUEL OIL ASPHALT

REDUCING THE METALS CONTENT OF PETROLEUM FEEDSTOCKS

BACKGROUND OF THE INVENTION

The present invention relates to an improved process for reducing the metals content of petroleum feedstocks, especially those feedstocks comprising high boiling fractions such as vacuum residua. The process comprises contacting the feedstock with phosphoric acid and separating a metals rich asphaltene fraction.

Demetallization using an acidic reagent has been suggested by various sources as one method to overcome the adverse effects of metallic contaminants found in petroleum feedstocks. For example, U.S. Pat. No. 2,778,777, granted Jan. 22, 1957, teaches the use of sulfuric acid to remove metals from petroleum oils. According to this patent the sulfuric acid reagent converts the metal containing constituents of the oil into water-soluble constituents or to constituents separable by conventional aqueous phase separation methods.

Subsequent investigators more thoroughly described the mechanism of acidic demetallization. They found that the metallic contaminants are innate constituents of the oil usually in the form of complex organic chelate compounds of the porphyrin type. Two forms of the porphyrin were observed, one volatile at temperatures between 1050° F. and 1250° F. and the other substantially non-volatile at such temperatures. The non-volatile contaminants are of low oil solubility and are for the most part colloidally dispersed in the oil. The volatile contaminants are soluble in oil and are for the most part in true solution.

U.S. Pat. Nos. 3,203,892, granted Aug. 31, 1965, and 3,245,902, granted Apr. 12, 1966, teach that when petroleum oils are treated with acidic reagents, such as concentrated sulfuric acid or halogenated acids, the principal reaction is a coagulation of the oil-insoluble metallic contaminants involving precipitation of the whole metallic molecule along with high molecular weight hydrocarbons associated with the metallic molecule. Thus, the coagulation step results in considerable loss of hydrocarbon material as acid sludge, and does not affect the volatile oil-soluble metallic contaminants. In order to remove these oil-soluble contaminants by acidic coagulation they must be converted to the oil-insoluble colloidal form by heat soaking or solvent precipitation. Thus, involving an extra processing step.

In order to overcome the deficiencies of acidic coagulation, U.S. Pat. Nos. 3,203,892 and 3,245,902 teach the use of hydrofluoric acid. It was found that, unlike other halogenated acids, hydrofluoric acid can be used to remove both oil-soluble and oil-insoluble metallic contaminants apparently by selective cleavage of the porphyrin molecule. The metals are removed as a solid insoluble filtrate while the bulk of the porphyrin molecule remains in the oil. Thus, the hydrocarbon content of the oil is essentially unaffected by this method of demetallization. However, hydrofluoric acid is a relatively hazardous material, and because of its highly corrosive properties is difficult to handle without special equipment.

Moreover, various conventional refining operations, especially residua processing, employ a preliminary deasphalting step. Thus, the use of an acidic coagulation to concentrate metallic contaminants in an asphaltene fraction would not appear to be a significant shortcoming where a deasphalting step was contemplated in any event. However, the acidic coagulation step also favors the formation of asphaltenes. Thus, demetallization methods which use acidic coagulation to concentrate the metallic contaminants in an asphaltene fraction and deasphalt the petroleum feedstock to remove the metals; unfortunately, result in an increased asphaltene content and a consequent loss of valuable hydrocarbon when the feedstock is deasphalted.

Accordingly, it is the primary object of the present invention to provide a process to remove metallic contaminants from petroleum feedstocks employing a relatively safe acidic reagent with a minimum formation of additional asphaltenes. This object and others are achieved by the invention summarized and then described in detail below.

BRIEF DESCRIPTION OF THE DRAWING

The Figure accompanying the Detailed Description of the Invention, below, illustrates a typical refinery flow diagram comprising the process of the present invention.

SUMMARY OF THE INVENTION

In accordance with the present invention it has been found that when a petroleum feedstock is contacted with phosphoric acid and subsequently deasphalted by conventional methods, the metals content of the resulting deasphalted oil is significantly reduced while the asphaltene content of the feedstock remains essentially constant. This discovery is particularly surprising in view of the transfer of metallic contaminants to the asphaltene constituents of the feedstock and the formation of asphaltenes, per se, generally attributed to acidic demetallization.

DETAILED DESCRIPTION OF THE INVENTION

The process provided by this invention comprises contacting a petroleum feedstock in the liquid phase with phosphoric acid under conditions which favor the concentration of metallic contaminants in an asphaltene fraction, and separating the asphaltene fraction to produce a demetalated deasphalted oil.

The process of the present invention is applicable to petroleum feedstocks, regardless of source, which are contaminated by metallic constituents. The most common of these metallic contaminants are vanadium, nickel, and iron complexes. They are present in various concentrations in all crude oils, but are particularly prevalent in the recently exploited heavy crudes from the Venezuelan, Mexican, and coastal Californian fields. Furthermore, since the metals are complexed, they concentrate in the high boiling fractions of such crudes. Accordingly, the process of the present invention is particularly useful as a pre-treatment for residuum upgrading operations, especially for operations which include a deasphalting step. For example, in a typical lubricating oil refining operation a crude oil is vacuum distilled to produce a lube oil distillate and a vacuum residuum. The residuum is deasphalted usually by a solvent refining method and finished by clay contacting or hydrofinishing. The process of the present invention can be applied to concentrate the metallic contaminants in the asphaltene fraction of the vacuum residuum, thus taking advantage of the deasphalting operation to remove the contaminants, as well as the asphaltenes.

As previously mentioned, the concentration of metallic contaminants in petroleum feedstocks which can be treated by the process of the present invention varies depending upon the crude oil source. Typical heavy crude oils contain from about 5 to about 100 parts per million (ppm) by weight of metal. However, the concentration of metals in heavy residuum fractions of such crude oils may be as high as 200 ppm and higher.

It has been found that the process of the present invention is particularly effective for reducing the iron content of petroleum feedstocks. While acid demetallization processes, including the present process, are effective with respect to reduction of the vanadium and nickel content; many of the previously employed processes are less effective with respect to reduction of the iron content. In contrast, the present process has been applied to iron contaminated feedstocks and has achieved nearly complete removal, over 99%. This result is especially significant when the demetalated product is fed to a catalytic hydroprocessing operation which is catalyzed by an iron sensitive catalyst. Most hydrocracking catalysts are poisoned by metals such as vanadium, nickel, and iron. Iron is generally the most reactive of these metals, and can rapidly foul hydroprocessing catalysts. In processes designed to hydrocrack deasphalted oil, iron can rapidly block catalyst pore openings. Iron can also build up in the interstitial volume between the catalyst particles leading to rapid pressure drop and increased or premature shut-downs of the hydroprocessing unit. Thus, the present process is particularly suited for use in a refinery operation wherein a vacuum residuum derived from a highly metals contaminated crude oil is intended as the feedstock to a deasphalting unit and the deasphalted product is fed to a catalytic hydrocracking unit.

In the first step of the present process a petroleum feedstock and an aqueous solution of phosphoric acid, $H_3PO_4$, are blended under inert conditions. By inert conditions is meant a substantially anaerobic environment and a temperature and pressure sufficient to maintain the feedstock in its liquid phase. Thus, the first step is carried out under a nitrogen or other conventional inert gas blanket and, for most feedstocks, at a temperature in the range from about 25° C. to about 260° C. at ambient pressure.

The aqueous phosphoric acid solution can be dilute to reduce the difficulties encountered when handling acidic solutions. Typical acceptable solutions will comprise from about twenty-five weight percent to about ninety-five weight percent phosphoric acid, although less concentrated solutions can be employed if appropriate contact time is allowed. Preferably the concentration of the solution will range from about thirty weight percent to about eighty-five weight percent phosphoric acid.

Concentrations of about eighty-five weight percent are particularly preferred. In order to improve blending the phosphoric acid into the liquid feedstock, it is preferable to mildly heat the feedstock being cautious to maintain inert conditions to avoid undesirable oxidation reactions. Accordingly, at ambient pressure, a temperature in the range from about 100° C. to 260° C. is preferred. In any event, the temperature of the blend should be maintained below about 300° C. since at about that temperature a significant amount of the phosphoric acid is converted to the dibasic and monobasic phosphorous acids. These acids have been employed in processes for treating petroleum feedstocks to improve the quality of their distillation products apparently by encouraging the formation of asphalt. U.S. Pat. No. 1,092,448, granted Apr. 7, 1914, discloses such a process. As already pointed out, one of the advantages of the present process is that it concentrates the metallic contaminants in the asphaltene fraction without significantly increasing the asphaltene content of the feedstock.

Under the foregoing conditions, no more than about two hours of contact time is required to concentrate the metallic contaminants in the asphaltene fraction. Generally, from about one minute to about one hour of contact time is sufficient. Some mixing within the contact zone improves blending and consequently minimizes the contact time. The contact time is also dependent upon the amount of phosphoric acid employed. Generally, the weight percent of phosphoric acid to feedstock may range from about 002.0 to about 000.1, preferably from about 001.0 to about 000.5.

The second step in the present process is conventional deasphalting of the phosphoric acid petroleum feedstock blend to remove the metals concentrated in the asphaltene fraction. Solvent deasphalting with, for example, aliphatic alcohols or propane is often used to refine lubricating oils, but any of the deasphalting methods is acceptable. Chapter 8 of *Petroleum Refining With Chemicals* by Kalichevsky and Kobe, Elsevier Publishing Company (1956), contains a thorough description of deasphalting methods.

The following Example illustrates a hypothetical embodiment of the present process and a laboratory demonstration confirming the results. From the Example it will be apparent to those familiar with the field of the invention that the present process may be modified without departing from the characterizing features defined in the Claims which follow the Example.

EXAMPLE

Referring to the accompanying drawing, the hypothetical refinery operation schematically illustrates one embodiment of the process of the present invention. In this illustration crude oil is introduced through line 1 into an atmospheric distillation column 2 and is separated into a variety of boiling range fractions. The light end hydrocarbon gases such as methane, ethane and propane are taken off overhead through line 3 and are used as refinery fuels. A naphtha fraction is withdrawn through vapor side stream line 4, a middle-distillate kerosene fraction is withdrawn through line 5, and an atmospheric gas oil is withdrawn through line 6. Typically, the naphtha fraction has a boiling range of from about 60° F. to 300° F., the kerosene fraction has a boiling range of from about 300° F. to about 500° F. and the atmospheric gas oil has a boiling range of from about 500° F. to about 650° F. Generally, the kerosene and atmospheric gas oil fractions, middle-distillates, are relatively free of metallic contaminants.

The atmospheric residual fraction boiling above the gas oil fraction and containing most of the metallic contaminants is taken off as a bottoms product through line 7 and is fed to vacuum distillation column 8. The light and heavy vacuum gas oils are separated and withdrawn through lines 9 and 10, respectively. The vacuum residuum fraction is taken off as a bottoms product through line 11 and fed to vacuum residuum stripper 12. The fraction boiling below 950° F. is taken off overhead through line 13 and fed to a catalytic hydrocracking unit for further upgrading. The fraction boiling above 950° F. is taken off as a bottoms product through line 14.

In the illustrated refinery operation, the stripped vacuum residuum comprising substantial amounts of metallic contaminants is fed to the demetallization process of the present invention. The portion of the refinery operation enclosed within the dotted-lines comprises the demetallization process. Although in the illustrated operation only the stripped vacuum residuum is fed to the present process, one or more of the heavy oil fractions withdrawn from the distillation columns could also have been fed to the process for demetallization. Whenever a specific feed was desired these fractions would be separately processed. However, the fractions could be mixed prior to treatment. Similarly, the illustrated operation comprises a complete separation of the crude oil into refinery feeds prior to the demetallization process. If desired, the crude oil separation could be simplified or the demetallization process could be carried out on a feedstock separated at an earlier point in the operation, for example, on the atmospheric residuum withdrawn through line 7.

Referring again to the drawing, the product inspections for vacuum residua derived from various crude oils processed in the illustrated operation are tabulated below:

TABLE I

Inspections of Vacuum Residua (1,000° F.+) of Representative Crudes

| Crude | Arabian Light | Arabian Heavy (Safaniya Field) | Iranian Sumatran Kuwait | Iranian Sumatran Heavy | Iranian Sumatran Light | Venezuelan | Alaskan North Slope | North Sea Ninian | Californian |
|---|---|---|---|---|---|---|---|---|---|
| Gravity, °API | 8.0 | 4.6 | 7.4 | 6.3 | 20.1 | 10.9 | 7.4 | 13.0 | 5.4 |
| Yield, LV % of Crude | 17.3 | 28.6 | 24.8 | 21.8 | 24.4 | 21.2 | 23 | 17.8 | 26.1 |
| Sulfur, % | 3.7 | 5.6 | 5.1 | 3.2 | 0.18 | 2.8 | 2.1 | 1.3 | 1.6 |
| Nitrogen, % | 0.49 | 0.67 | 0.38 | 0.83 | 0.33 | 0.56 | 0.64 | 0.42 | 1.33 |
| Asphaltenes, % | 11.3 | 20.6 | 12.0 | 14.7 | 7.9 | 16.0 | 8.1 | 6.9 | 12.0 |
| Ni + V, ppm | 96 | 220 | 116 | 462 | 41 | 666 | 130 | 28 | 294 |
| Fe, ppm | — | 10 | 0.9 | 9 | 13 | 5 | 15 | 1 | 90 |

Although any of these residua can be demetalated by the present process, the unusually high iron content of the vacuum residuum derived from Californian crude makes it a particularly good candidate for treatment in the process of the present invention. Similarly, the high nickel and vanadium content of the vacuum residuum derived from Venezuelan crude makes it a good candidate for treatment in the present process.

In the first step of the present process, the vacuum residuum, withdrawn through line 14, is fed to mixing zone 15. Mixing zone 15 comprises a vessel fitted with a suitable means for agitation and heating. The vessel is blanketed using an inert gas such as nitrogen, insulated, and equipped with heating coils used to heat the residuum to an appropriate temperature and maintain that temperature while a solution of phosphoric acid is blended into the residuum through line 16. Only a moderate amount of agitation is required and the temperature should not be raised above about 300° C. or the temperature at which the phosphoric acid will decompose. At higher temperatures, compounds from the phosphoric acid will react with the residuum to form asphaltenes.

Under the desired mixing conditions, detailed previously, the phosphoric acid in contact with the residuum concentrates the metallic contaminants in the asphaltene fraction of the residuum. Accordingly, in the illustrated operation the second step in the present process comprises passing the effluent mixture from mixing zone 15 through line 17 to a conventional solvent deasphalting unit 18. In solvent deasphalting unit 18 the effluent mixture is contacted with a suitable solvent fed through line 19. The solvent deasphalting unit typically consists of a series of countercurrent contacts between the solvent and the residuum. The physical properties of the solvent govern the conditions of deasphalting unit 18. Generally, low temperatures and high pressures are used to avoid volatilizing the solvent. Separation of the solvent from the product deasphalted oil and tar is carried out by a fractionation method such as flashing or steam stripping and the solvent is recycled to line 19. In the illustrated operation, a low molecular weight solvent selectively dissolves the maltene fraction or stated conversely selectivity precipitates the asphaltene fraction. Thus, a demetalated maltene fraction or deasphalted oil (DAO) is withdrawn through line 20 and passed to flashing zone 21. Solvent is recycled through line 22 to line 19 and the demetalated deasphalted oil is fed through line 23 to catalytic hydrocracking unit 24 for further upgrading. The asphaltene fraction containing the metallic contaminants is withdrawn from deasphalting unit 18 through line 25 and is also stripped of entrained solvent (not illustrated) and recycled to line 19. The stripped asphaltene fraction is blended with a cutter oil fed through line 26 and sent to fuel oil or asphalt storage. The DAO product is a substantially metals-free product suitable for catalytic upgrading.

In order to confirm the advantages of the process of the present invention, it was demonstrated as follows:

A 250 g. sample of a 1000° F. plus vacuum resid having the inspections set forth in Table II below, was stirred and heated under in an inert atmosphere (nitrogen purge, blanket). When the temperature had reached about 150° C., one weight percent of 85.1% aqueous $H_3PO_4$ (Baker Reagent Grade) was added. The resid/$H_3PO_4$ mixture was blended under nitrogen, and the temperature gradually raised to about 260° C. After 44 minutes, a sample was drawn for testing. This sample was separated into a maltenes (pentane solubles) fraction and asphaltenes (pentane insolubles) fraction. The fractions were dried (vacuum with nitrogen bleed) and weighed. Metal analyses were done by ICP.

TABLE II

| 1000°F.+ Vacuum Resid Inspections | |
|---|---|
| Sulfur, Wt. % | 3.31% |
| Ni/V/Fe, ppm | 212/190/240 |

TABLE II-continued

| 1000°F.+ Vacuum Resid Inspections | |
|---|---|
| Pour Pt., °F. | 215° |
| Ramsbottom Carbon, Wt. % | 24.24% |
| Hot $C_7$ Asphaltenes, Wt. % | 15.4% |
| Ni/V/Fe Asphaltenes, ppm | 654/1164/573 |
| Sulfur in Asphaltenes, Wt. % | 3.12% |
| Viscosity, cs at 100° C. | No Flow |

As shown in Table III below, the $H_3PO_4$ treated resid showed substantial decreases in the concentration of metals, especially iron, in the maltenes. Further, as shown in Table IV below, there was only a 1.5% increase in asphaltenes (when $H_3PO_4$ contribution is taken into account).

TABLE III

| Effect of $H_3PO_4$ on Metal Concentrations | Fe ppm | Ni ppm | V ppm |
|---|---|---|---|
| Resid (original) | | | |
| Maltenes | 64 | 101 | 63.3 |
| Asphaltenes | 894 | 468 | 461 |
| $H_3PO_4$ Treated Resid | | | |
| Maltenes | <0.06 | 14.5 | 9.70 |
| Asphaltenes | 750 | 372 | 392 |

TABLE IV

| Effect of $H_3PO_4$ on Organic Fractions | % Maltenes | % Asphaltenes |
|---|---|---|
| Residuum (original) | 72 | 28 |
| $H_3PO_4$ Treated Resid | 70* | 30 |

*≧1.0% due to $H_3PO_4$ added

The Example illustrates a single application of the process of the present invention. The following claims should not be construed to be limied by the Example.

What is claimed is:

1. A process for treating petroleum feedstocks which comprises contacting said feedstock in its liquid phase with phosphoric acid under substantially anaerobic conditions to concentrate metallic contaminants in an asphaltene fraction of said feedstock wherein the weight percent of phosphoric acid to feedstock is in the range of from about 002.0 to about 00.1.

2. A process according to claim 1 wherein said conditions which will concentrate the metallic contaminants in an asphaltene fraction comprise a temperature below about 300° C.

3. A process according to claim 2 wherein said temperature is in the range of from 100° C. to about 260° C.

4. A process according to claim 1 wherein said contacting is carried out with mild agitation.

5. A process according to claim 1 wherein said feedstock is a residuum derived from a crude oil comprising nickel, vanadium and/or iron.

6. A process according to claim 5 wherein said crude oil comprises from about 5 ppm to 100 ppm by weight of metals.

7. A process according to claim 5 wherein said residuum is a vacuum residuum comprising at least 200 ppm by weight of metals.

8. A process according to claim 7 wherein said range is from about 001.0 to about 000.5.

9. A process according to claim 1 wherein substantially anaerobic conditions are obtained using an inert gas blanket.

10. A process according to claim 9 wherein said inert gas is a nitrogen.

11. A process according to claim 1, 2, 3, 4, 5, 6, 7, 8, 9 or 10 comprising an additional step of separating said asphaltene fraction from said feedstock.

12. A process according to claim 11 wherein said separation is carried out by a solvent deasphalting method.

* * * * *